US011274261B2

(12) United States Patent
D'Aloia et al.

(10) Patent No.: US 11,274,261 B2
(45) Date of Patent: Mar. 15, 2022

(54) LUBRICANT ADDITIVES FOR METAL WORKING

(71) Applicant: Lamberti SPA, Albizzate (IT)

(72) Inventors: Alessandro D'Aloia, Novi Ligure (IT); Dario Fornara, Novara (IT); Gabriele Greco, Sugar Land, TX (US); Alessandro Lugari, Opera (IT); Giovanni Floridi, Novara (IT); Giuseppe Li Bassi, Gavirate (IT)

(73) Assignee: Lamberti SPA, Albizzate (IT)

( * ) Notice: Subject to any disclaimer, the term of this patent is extended or adjusted under 35 U.S.C. 154(b) by 0 days.

(21) Appl. No.: 17/289,355

(22) PCT Filed: Nov. 12, 2019

(86) PCT No.: PCT/EP2019/080982

§ 371 (c)(1),
(2) Date: Apr. 28, 2021

(87) PCT Pub. No.: WO2020/104248

PCT Pub. Date: May 28, 2020

(65) Prior Publication Data

US 2021/0355407 A1 Nov. 18, 2021

(30) Foreign Application Priority Data

Nov. 19, 2018 (IT) ..... 102018000010416

(51) Int. Cl.

| | |
|---|---|
| ***C10M 137/08*** | (2006.01) |
| ***C10M 137/06*** | (2006.01) |
| ***C10M 173/02*** | (2006.01) |
| *C10N 40/20* | (2006.01) |
| *C10N 30/08* | (2006.01) |
| *C10N 40/22* | (2006.01) |
| *C10N 40/24* | (2006.01) |

(52) U.S. Cl.

CPC ..... *C10M 137/08* (2013.01); *C10M 137/06* (2013.01); *C10M 173/02* (2013.01); *C10M 2201/02* (2013.01); *C10M 2223/042* (2013.01); *C10M 2223/043* (2013.01); *C10N 2030/08* (2013.01); *C10N 2040/22* (2013.01); *C10N 2040/24* (2013.01); *C10N 2040/246* (2020.05)

(58) Field of Classification Search

CPC ..... C10M 137/04; C10M 173/02; C10M 2223/04; C10M 2223/042; C10M 2223/043; C10M 137/06; C10M 137/08; C10M 2201/02; C10N 2040/20; C10N 2080/00; C10N 2010/02; C10N 2040/24; C10N 2030/08; C10N 2040/22; C10N 2040/246; C10N 2030/12; C10N 2030/02

See application file for complete search history.

(56) References Cited

U.S. PATENT DOCUMENTS

| | | | | |
|---|---|---|---|---|
| 5,064,500 | A * | 11/1991 | Awad | C10M 105/22 216/103 |
| 6,592,775 | B1 | 7/2003 | Skold | |
| 2007/0087944 | A1 * | 4/2007 | Phillips | C10M 169/04 508/433 |
| 2018/0079986 | A1 | 3/2018 | Palmer et al. | |

FOREIGN PATENT DOCUMENTS

| | | | |
|---|---|---|---|
| CN | 104710610 | A | 6/2015 |
| WO | 2017102726 | A1 | 6/2017 |

OTHER PUBLICATIONS

ISR-WO for parent application PCT/EP2019/080982 dated Mar. 4, 2020.
Written Opinion of the international Search Authority for PCT/EP2019/080982 dated Feb. 6, 2020.
International Search Report for PCT/EP2017/075081 dated Feb. 6, 2020.

* cited by examiner

*Primary Examiner* — Vishal V Vasisth
(74) *Attorney, Agent, or Firm* — Vorys, Sater, Seymour and Pease LLP; Iona Niven Kaiser

(57) ABSTRACT

Method for increasing lubrication in metal working processes by the use of phosphate esters of propoxylated and ethoxylated alcohols.

10 Claims, No Drawings

LUBRICANT ADDITIVES FOR METAL WORKING

CROSS REFERENCE TO RELATED APPLICATIONS

This application is the U.S. national phase of PCT Application No. PCT/EP2019/080982 filed on Nov. 12, 2019, which claims priority to Italian patent application number 102018000010416 filed on Nov. 19, 2018, the contents of both applications are hereby expressly incorporated by reference herein.

TECHNICAL FIELD

The invention relates to a method for increasing lubrication in metal working processes. Specifically, the invention relates to the use of phosphate esters of propoxylated and ethoxylated alcohols as lubricating additives.

PRIOR ART

The use of high machine speeds in metal working operations such as cutting, drilling, rolling, drawing, shaping and the like has placed severe demands on the fluid employed to cool and lubricate the tool and metal-work piece. The enormous amount of heat generated at the tool-work piece interface must be quickly dissipated in order to prevent damage to the tools and work-pieces. The second major requirement of metal working fluids is the reduction of friction between the tool and work piece to prevent wear, scoring and welding of the contacting parts. The requirements of cooling and lubricating place severe restrictions on the composition of metal working lubricants.

Mineral lubricating oils afford excellent lubrication and reduce friction but are relatively poor coolants, have a tendency to form undesirable deposits and excessive smoke at high temperatures.

Water is an excellent cooling fluid because of its high heat capacity, but it is almost completely deficient in lubricating properties. Moreover, water based fluids do have a tendency to cause rusting or corrosion of the tools and metal.

In order to resolve these problems, various lubricant additives for metal working fluids have been developed.

These additives traditionally include organic substances that contain at least one of the following heteroatoms: halogens, sulfur, nitrogen, and phosphorus. One of the major reasons for the presence of substances including these heteroatoms is to inhibit corrosion of the metals being worked.

Among the organic substances containing phosphorus, phosphate esters of hydroxyl containing compounds have found widespread use in metal working fluids.

U.S. Pat. No. 3,422,166 relates to the use in lubricating compositions of a reaction product of triethanolamine and an ester of formula:

$$[R—O—(CH_2CHO)_n]_x—P(=O)(OH)_{3-x}$$

wherein x is 1 or 2; R is an aliphatic hydrocarbon group with at least 9 carbon atoms and n is an integer from about 3 to about 30; the proportions of triethanolamine and ester being such that a neutral product is produced. U.S. Pat. No. 4,758,359 relates to a water soluble metal working lubricant comprising one organic phosphate (partial) ester of a polyoxyalkylated alcohol wherein the alcohol portion is derived from a member of the group consisting of saturated and unsaturated alkyl radicals having from about 1 to about 20 carbon atoms, aryl radicals, and alkylaryl radical wherein the alkyl substituent comprises from about 1 to about 20 carbon atoms and is saturated or unsaturated.

U.S. Pat. No. 5,399,274 describes a lubricant composition containing a fatty acid neutralized with an amino alcohol and a phosphate monoester and/or diester of an ethoxylated alkyl or alkylaryl alcohol.

U.S. Pat. No. 6,592,775 discloses an aqueous metal working liquid comprising a non-ionic polypropylene glycol compound and an anionic phosphate ester of compounds of the formula RO(AO)nH, in which R is hydrogen or a hydrocarbon group having 1-12 carbon atoms, AO is an alkyleneoxy group having 2-3 carbon atoms, at least 50% of all the alkyleneoxy groups being propyleneoxy groups, and n is a number from 6 to 100.

WO 2017/102726 relates to a lubricating composition suitable for working and shaping metals including polymers of the following formula:

$$[R—O—(CH(CH_3)—CH_2—O—)_n—(CH2\text{-}CH2\text{-}O—)_p]_{1+x}P(=O)(OH)_{2-x}$$

in which: R is a linear or branched, preferably linear, saturated or unsaturated hydrocarbon group, comprising between 8 and 12 carbon atoms; n is a number, which may or may not be an integer, between 6 and 20; p is a number, which may or may not be an integer, between 4 and 25; and x is a number between 0 and 1.

WO 2018/057519 describes an additive defined by the formula:

$$[R^1—(CO)_yO(CH_2CHR^2O)z]_nPO_{4-n}X_{3-n}$$

wherein: $R^1$ is a saturated or unsaturated, branched or linear, alkyl or aryl hydrocarbon group comprising at least 10 to no more than 24 carbons; each $R^2$ is independently selected from H and alkyl of 1-5 carbons; X is a cation or hydrogen; y is 0 or 1; z is an integer of 1 to 20; and n is 1 or 2.

Now, we have surprisingly found that phosphate esters of specific propoxylated and subsequently ethoxylated alcohols show lubricating performances remarkably higher than phosphate esters of the alkoxylated alcohols of the prior art.

In addition, the specific esters of the present invention possess corrosion inhibition properties, show substantial advantages of low temperature stability (lower pour point) and can be advantageously used as lubricating additives both in water-based fluids or in oil-based fluids.

As far as the Applicant knows, no one has described before the specific esters of the present invention and their remarkable properties.

WO 2017/102726 and WO 2018/057519 also describes phosphate esters of propoxylated and ethoxylated alcohols, but fail to describe the specific esters of the present invention and do not disclose or suggest their advantageous characteristics.

In the present invention, forming and cutting of metals are processes included in expression "metal working".

DESCRIPTION OF THE INVENTION

It is an object of the present invention a method for increasing lubrication in metal working processes comprising the step of adding to metal working fluids phosphate esters of formula I:

I

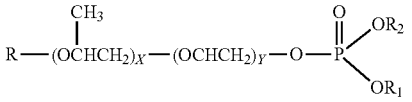

wherein R is the residue of one or more linear or branched $C_{12}$-$C_{18}$ aliphatic alcohols and at least 70% by weight of said aliphatic alcohols is made up of one or more linear or branched $C_{14}$-$C_{16}$ aliphatic alcohols;

x is the average number of propoxy groups and ranges from 3 to 6.5;

y is the average number of ethoxy groups and ranges from 3 to 8;

$R_1$ is hydrogen, an alkali metal, the ammonium ion, a protonated amine, a quaternary organic ammonium or an alkaline earth metal;

$R_2$ is like $R_1$ or is a radical of formula:

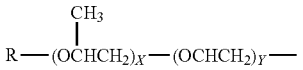

wherein R, x and y have the same meaning as reported above.

It is another object of the present invention a method for increasing lubrication in metal working processes comprising the use in metal working fluids containing phosphate esters of formula I:

I

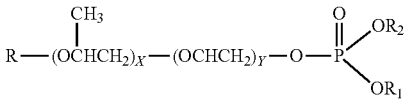

wherein R is the residue of one or more linear or branched $C_{12}$-$C_{18}$ aliphatic alcohols and at least 70% by weight of said aliphatic alcohols is made up of one or more linear or branched $C_{14}$-$C_{16}$ aliphatic alcohols;

x is the average number of propoxy groups and ranges from 3 to 6.5;

y is the average number of ethoxy groups and ranges from 3 to 8;

$R_1$ is hydrogen, an alkali metal, the ammonium ion, a protonated amine, a quaternary organic ammonium or an alkaline earth metal;

$R_2$ is like $R_1$ or is a radical of formula:

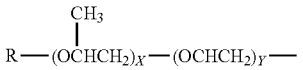

wherein R, x and y have the same meaning as reported above.

Still another objet of the present invention is the use of phosphate esters of formula I, as defined above, as lubricating additive for metal working fluids.

An object of the invention is also a metal working fluid comprising from of 0.01 to 10 wt % of said phosphate esters of formula I and from 50 to 80 wt % of at least one lubricating oil.

Still another object of the invention is a metal working fluid comprising from of 0.01 to 10 wt % of said phosphate esters of formula I and from 50 to 80 wt % of water.

DETAILED DESCRIPTION OF THE INVENTION

Preferably, in formula I R is the residue of one or more linear or branched $C_{12}$-$C_{18}$ aliphatic alcohol and at least 80% by weight, more preferably at least 90% by weight, most preferably at least 95% by weight, of said aliphatic alcohols is made up of one or more linear or branched $C_{14}$-$C_{16}$ aliphatic alcohols.

In a preferred embodiment, R is the residue of one or more linear or branched $C_{14}$-$C_{16}$ aliphatic alcohols.

In a more preferred embodiment, R is the residue of a mixture of linear and branched $C_{14}$-$C_{16}$ aliphatic alcohols.

In the most preferred embodiment, R is the residue of a mixture of $C_{14}$-$C_{15}$ linear and branched aliphatic alcohols.

Preferably, x is a number from 3.5 to 5.5, more preferably from 3.5 to 4.5.

Preferably, y is a number from 4 to 6.5, more preferably from 4.5 to 5.5. More preferably, x is a number from 3.5 to 5.5 and y is a number from 4 to 6.5.

Most preferably, x is a number from 3.5 to 4.5 and y is a number from 4.5 to 5.5.

Preferably, $R_1$ is hydrogen, an alkali metal, the ammonium ion, a protonated amine or a quaternary organic ammonium. More preferably, $R_1$ is hydrogen, an alkali metal, such as sodium or potassium, or a protonated amine. Protonated amines are particularly preferred. Examples of suitable amines are alkyl amines and alkanol amines, with ethanolamine, propanol amine and ethyl amine being the most preferred.

Examples of suitable esters of formula I include mixtures of phosphoric acid monoesters (degree of esterification=1) or mixtures of phosphoric acid diesters (degree of esterification=2) or mixtures of phosphoric acid monoesters and diesters.

Mixtures of monoesters and diesters having an average degree of esterification ranging from 0.9 to 1.8, preferably from 1.1 to 1.6, are preferred.

The esters of formula I may be produced by conventional methods.

For example, they may be prepared by esterifying the adduct resulting from the propoxylation and subsequent ethoxylation (with x moles propylene oxide and y moles ethylene oxide, respectively) of one or more linear or branched $C_{12}$-$C_{18}$ aliphatic alcohols, wherein at least 70% by weight of said alcohols is made up of one or more linear or branched $C_{14}$-$C_{16}$ aliphatic alcohols, with a phosphating agent, e.g. $P_2O_5$ or phosphoric acid or a derivative thereof, for example a polyphosphoric acid, such as tetraphosphoric acid. The esterification into phosphoric esters is advantageously carried out at a temperature from 35 to 110° C. The alkoxylation steps are preferably carried out in the presence of a conventional catalyst, for example an alkali metal hydroxide.

According to the method of the present invention, the esters of formula I can be can be added to both oil-based metal working fluids and water-based metal working fluids. The latter being preferred for their higher environmental compatibility.

Metal working fluids comprising esters such as those disclosed herein can be finished fluids, concentrates or packages.

The oil-based metalworking fluid can comprise from of 0.01 to 10 wt % of said phosphate esters of formula I and from 50 to 80 wt % of at least one lubricating oil.

The at least one lubricating oil includes natural or synthetic lubricating oils.

Natural lubricating oils include animal oils, vegetable oils, mineral oils and mixtures thereof.

Synthetic lubricating oils include hydrocarbon oils, oils derived from hydrocracking, halo-substituted hydrocarbon oils, silicon-based oils, polyalphaolefins, such as those prepared from dodecene and decene, and esters such as an adipate. The synthetic oil can be at least in-part a polymer chosen, for example, among hydrogenated copolymers of styrene-butadiene, ethylene-propylene polymers, polyisobutenes, hydrogenated styrene-isoprene polymers, hydrogenated isoprene polymers, polyalkyl styrenes, etc.

Due to their compatibility with water and other desirable characteristics, the esters of formula I of this invention are particularly suitable as additives for water-based metal working fluids useful where, in addition to lubrication, a high degree of cooling is desired.

Usually, the water-based metal working fluid comprises from of 0.01 to 10 wt % of said phosphate esters of formula I and from 50 to 80 wt % of water. Typically, water-based lubricant systems of this type include dispersions and emulsions. The water-based metalworking fluids of the invention are obtained by mixing water and a lubricating oil and adding the esters of the invention and a suitable emulsifying or dispersing agent.

The lubricating oil can be chosen among natural or synthetic oils, such as those described above.

The emulsifying/dispersing agents can be selected from a wide variety of known compounds such as anionic, nonionic, cationic and amphoteric surfactants and mixture thereof.

The water-based metalworking lubricant fluids can contain other additives including, for example, biocides, oxidation inhibitors, corrosion inhibitors, metal deactivators, antiwear agents, extreme pressure additives, hydrodynamic additives, flow additives, defoamers, colorants, etc., and combinations thereof.

The esters of formula I are preferably used in an amount of 0.1 to 5 wt % on the basis of the total amount of the metal working fluid.

The esters of formula I are excellent lubricants for both ferrous and non-ferrous metals and the metal working fluids containing them can be used for a wide variety of applications.

Examples of these applications include metal cutting processes such as cutting, drilling, grinding, turning, milling, tapping and broaching, or metal forming processes, including rolling, forging, molding, stamping, casting, drawing and extruding.

EXAMPLES

The alkoxylated alcohols of Table 1 were reacted with phosphoric anhydride in a molar ratio of 3:1 for about 4 hours at 45-50° C. Mixtures of acidic fosforic esters with an esterification degree of about 1.5 were obtained.

Table 1 reports the chemical identity of the phosphate esters with the average number of propoxy groups (PO) and ethoxy groups (EO) and also their pour point (° C.), determined according to ASTM D97-17b.

TABLE 1

| | Identity | Pour Point |
|---|---|---|
| Reference* | Lubhrophos LB 400 | 15 |
| Example 1* | Part. Branched $C_{14-15}$ Alcohols 1.5 PO 4.5 EO Phosphate | 12 |
| Example 2* | Part. Branched $C_{14-15}$ Alcohols 2.5 PO 4.5 EO Phosphate | 5 |
| Example 3 | Part. Branched $C_{14-15}$ Alcohols 4 PO 5 EO Phosphate | −3 |
| Example 4* | 2-Heptyl 1 Undecanol 3.5 EO Phosphate | 20 |
| Example 5* | Part. Branched $C_{14-15}$ Alcohols 7.5 PO 5 EO Phosphate | <−15 |
| Example 6* | Branched $C_{13}$ Alcohol 4 PO 5 EO Phosphate | <−15 |
| Example 7* | Linear $C_{12}$ Alcohol 7.5 PO 5 EO Phosphate | <−15 |
| Example 8* | Linear $C_{12}$ Alcohol 4 PO 5 EO Phosphate | <−15 |

*Comparative

Lubrication Tests 2 wt % aqueous solutions of the esters of the Example 1-9, all neutralized with monopropanol amine, were used as test fluids.

The reference fluid was a 2.0 wt % aqueous solution of Lubhrophos LB400 (phosphate ester of ethoxylated cetyl/oleyl alcohols), a well-known and excellent lubricant.

Lubricating performances were evaluated with a Microtap II thread tapping machine (manufactured by Microtap USA, Inc.), which cuts threads in pre-drilled holes.

Tests were performed on 1018 cold rolled steel bars with 6.0 mm diameter holes.

Holes were isolated by mean of adhesive tape covering top and bottom of the bar.

Tapping was performed using uncoated high-speed steel (HSS) taps (for 1018 steel) and the amount of torque recorded. The tests were ran at the following RPM's:

500 RPM simulating a light-duty machining operation (Table 2);

650 RPM simulating a heavy-duty machining operation (Table 3);

750 RPM simulating a very heavy-duty machining operation (Table 4).

Test results are reported in Tables 2-4 as % efficiency. The % efficiency is the ratio of the torque value of the fluid containing the additive according to the invention (Example 3) to the torque value of fluid containing the comparative additives.

The fluid of Example 3 has been assigned an efficiency of 100%.

The test results demonstrate that the phosphate ester according to the invention shows a low pour point and largely outperforms at any operating speed the comparative phosphate esters and also the commercial product Lubrhophos LB-400.

The results obtained in the simulation of a very heavy-duty machining operation are particularly remarkable.

TABLE 2

| | % Efficiency |
|---|---|
| Reference* | 88.7 |
| Example 1* | 88.3 |
| Example 2* | 87.0 |
| Example 3 | 100.0 |
| Example 4* | 85.0 |
| Example 5* | 86.3 |
| Example 6* | 90.7 |

TABLE 2-continued

| | % Efficiency |
|---|---|
| Example 7* | 89.9 |
| Example 8* | 92.2 |

*Comparative

TABLE 3

| | % Efficiency** |
|---|---|
| Reference* | 89.6 |
| Example 1* | 83.7 |
| Example 2* | 84.8 |
| Example 3 | 100.0 |
| Example 4* | 84.8 |
| Example 5* | NA |

*Comparative
**NA = Not Applicable, out of range of the instrument (>600 Ncm)

TABLE 4

| | % Efficiency ** |
|---|---|
| Reference* | NA |
| Example 1* | NA |
| Example 2* | 77.2 |
| Example 3 | 100.0 |
| Example 4* | NA |
| Example 5* | NA |

*Comparative
**NA = Not Applicable, out of range of the instrument (>600 Ncm)

The invention claimed is:

1. A method for increasing lubrication in metal working processes comprising the step of adding to a metal working fluid one or more phosphate esters of formula I:

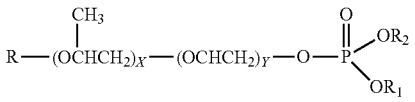

I wherein R is the residue of one or more linear or branched $C_{12}$-$C_{18}$ aliphatic alcohols and at least 70% by weight of said aliphatic alcohols is made up of one or more linear or branched $C_{14}$-$C_{16}$ aliphatic alcohols;

x is the average number of propoxy groups and ranges from 3 to 6.5;

y is the average number of ethoxy groups and ranges from 3 to 8;

$R_1$ is hydrogen, an alkali metal, an ammonium ion, a protonated amine, a quaternary organic ammonium or an alkaline earth metal;

$R_2$ is like $R_1$ or is a radical of formula:

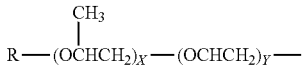

wherein R, x and y have the same meaning as reported above, and wherein $R_1$ and $R_2$ are not both hydrogen.

2. The method of claim 1), wherein R is the residue of one or more linear or branched $C_{12}$-$C_{18}$ aliphatic alcohols and at least 80% by weight of said aliphatic alcohols is made up of one or more linear or branched $C_{14}$-$C_{16}$ aliphatic alcohols.

3. The method of claim 2), wherein R is the residue of one or more linear or branched $C_{14}$-$C_{16}$ aliphatic alcohols.

4. The method of claim 1), wherein x is a number from 3.5 to 5.5.

5. The method of claim 1), wherein y is a number from 4 to 6.5.

6. The method of claim 1), wherein x is a number from 3.5 to 4.5 and y is a number from 4.5 to 5.5.

7. The method of claim 1), wherein $R_1$ is hydrogen, an alkali metal or a protonated amine.

8. The method of claim 1), wherein the metal working fluid comprises from of 0.01 to 10 wt % of phosphate esters of formula I-described in claim 1) and from 50 to 80 wt % of a lubricating oil.

9. The method of claim 1), wherein the metal working fluid comprises from of 0.01 to 10 wt % of a phosphate esters of formula I described in claim 1) and from 50 to 80 wt % of water.

10. The method of claim 1), further comprising applying the metal working fluid to a metal in a process selected from cutting, drilling, grinding, turning, milling, tapping and broaching, or metal forming processes.

* * * * *